US006780201B2

(12) United States Patent
Sun et al.

(10) Patent No.: US 6,780,201 B2
(45) Date of Patent: Aug. 24, 2004

(54) HIGH WET RESILIENCY CURLY CELLULOSE FIBERS

(75) Inventors: Tong Sun, Neenah, WI (US); Jeffrey Dean Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/017,487

(22) Filed: Dec. 11, 2001

(65) Prior Publication Data

US 2003/0108739 A1 Jun. 12, 2003

(51) Int. Cl.[7] ..... D06M 11/38; D06M 13/00; D21C 9/00

(52) U.S. Cl. ..... 8/125; 8/120; 8/115.51; 162/9

(58) Field of Search ..... 8/115.51, 120, 8/125, 115.57; 162/9

(56) References Cited

U.S. PATENT DOCUMENTS

| | | | | |
|---|---|---|---|---|
| 3,224,926 | A | 12/1965 | Bernardin | 162/146 |
| 3,338,992 | A | 8/1967 | Kinney | 264/24 |
| 3,341,394 | A | 9/1967 | Kinney | 161/72 |
| 3,440,135 | A | 4/1969 | Chung | 162/157 |
| 3,502,538 | A | 3/1970 | Petersen | 161/150 |
| 3,502,763 | A | 3/1970 | Hartmann | 264/210 |
| 3,542,615 | A | 11/1970 | Dobo et al. | 156/181 |
| 3,692,618 | A | 9/1972 | Dorschner et al. | 161/72 |
| 3,802,817 | A | 4/1974 | Matsuki et al. | 425/66 |
| 3,849,241 | A | 11/1974 | Butin et al. | 161/169 |
| 4,210,489 | A | 7/1980 | Markofsky | 162/164 |
| 4,242,408 | A | 12/1980 | Evani et al. | 442/119 |
| 4,340,563 | A | 7/1982 | Appel et al. | 264/518 |
| 4,689,118 | A | 8/1987 | Makoui et al. | 162/100 |
| 4,822,453 | A | 4/1989 | Dean et al. | 162/157.6 |
| 4,888,093 | A | 12/1989 | Dean et al. | 162/157.6 |
| 4,889,595 | A | 12/1989 | Herron et al. | 162/157.6 |
| 4,889,596 | A | 12/1989 | Schoggen et al. | 162/157.6 |
| 4,898,642 | A | 2/1990 | Moore et al. | 162/157.6 |
| 5,137,537 | A | 8/1992 | Herron et al. | |
| 5,160,582 | A | 11/1992 | Takahashi | 162/117 |
| 5,183,707 | A | 2/1993 | Herron et al. | 428/364 |
| 5,190,563 | A | 3/1993 | Herron et al. | 8/120 |
| 5,484,896 | A | 1/1996 | Naieni et al. | 530/504 |
| 5,549,791 | A | 8/1996 | Herron et al. | 162/157.6 |
| 5,562,740 | A | 10/1996 | Cook et al. | 8/120 |
| 5,709,774 | A | 1/1998 | Naieni | 162/9 |
| 5,716,703 | A | 2/1998 | Payne | 428/378 |
| 5,834,095 | A | 11/1998 | Dutkiewicz et al. | 428/191 |
| 5,837,627 | A | 11/1998 | Halabisky et al. | 442/385 |
| 5,858,021 | A | 1/1999 | Sun et al. | 8/125 |
| 5,873,979 | A | 2/1999 | Naieni | 162/157.6 |
| 6,133,170 | A | 10/2000 | Suenaga et al. | 442/334 |
| 6,248,879 | B1 | 6/2001 | Anderson et al. | 536/80 |

FOREIGN PATENT DOCUMENTS

| | | |
|---|---|---|
| DE | 29 36 239 | 3/1981 |
| EP | 427 316 | 5/1991 |
| WO | 00/39387 | 7/2000 |
| WO | 00/39389 | 7/2000 |

*Primary Examiner*—Margaret Einsmann
*Assistant Examiner*—Preeti Kumar
(74) *Attorney, Agent, or Firm*—Pauley Petersen & Erickson

(57) ABSTRACT

Curly cellulose fibers having a high wet resiliency and a method of making high wet resiliency curly cellulose fibers with a chemically-assisted curling method. Polymeric reactive compounds are used to provide intrafiber crosslinking in curly fibers, thereby chemically setting the curl in the fibers, resulting in fibers that are stiff enough to not collapse upon wetting. These high wet resiliency curly cellulose fibers maintain a capillary structure during fluid acquisition and distribution, thus increasing absorbency.

74 Claims, No Drawings

HIGH WET RESILIENCY CURLY CELLULOSE FIBERS

BACKGROUND OF THE INVENTION

Cellulose fibers are used in a number of applications, including absorbent products. Absorbent properties of cellulosic fibers can be enhanced by a variety of treatments. For example, fibers can be individually cross-linked, thereby physically or mechanically curling the fibers to impart increased absorbent capacity, bulk, and resilience. However, when curly fibers get wet, they typically lose their curl as well as their resiliency. Essentially, curly fibers collapse when wet. A mat of fibers can lose much of its former void volume when wetted, particularly if a compressive load is applied to the wet mat, resulting in decreased absorbent capacity. Curly fibers are more likely to maintain higher absorbent capacity if they can maintain their shape.

In the past, curling of fibers has been done primarily by mechanical means, resulting in densification of portions of the fiber wall and mechanical damage to fibers. Also in the past, many cross-linking efforts have tended to decrease the hydrophilicity of fibers, often by consumption of available hydroxyl groups on the fiber.

It is therefore an object of the present invention to provide curly fibers that maintain their shape when wet.

It is another object of the present invention to provide a method of creating curly cellulosic fibers without the need for mechanically curling the fibers.

It is a further object of the present invention to provide a method of creating curly cellulosic fibers that maintains or improves the hydrophilic nature of the fibers or the fiber mat.

SUMMARY OF THE INVENTION

The present invention is generally directed to a high wet resiliency curly cellulose fiber and a method of making high wet resiliency curly cellulose fibers. The high wet resiliency allows the fiber to be stiff enough to not collapse upon wetting. Additionally, high curl or kink in the fiber remains upon wetting, thus allowing the fiber to maintain void volume. These high wet resiliency curly fibers maintain a capillary structure during fluid acquisition and distribution thereby increasing absorbency.

The fibers of the invention are made from fibers treated with an intracrystalline swelling agent to have increased affinity to curl, and are further treated with a polymeric reactive compound that stabilizes the fiber curl, optionally without significant loss in the hydrophilic nature of the fiber. The polymeric reactive compound can be a polycarboxylic acid, a polyanhydride, a copolymer comprising multiple carboxylic acid groups or cyclic anhydride groups or salts thereof, a polyaldehyde or copolymer comprising multiple aldehyde groups, and the like. In one embodiment, however, the polymeric reactive compound is substantially free of aldehyde groups; likewise, a solution comprising the polymeric reactive compound can be substantially free of aldehydes. In another embodiment, a solution comprising the polymeric reactive compound is substantially free of low-molecular weight carboxylic acids, such as C2–C9 polycarboxylic acids. The polymeric reactive compound provides intrafiber crosslinking to impart the desired absorbent properties to the fibers.

In one embodiment, the polymeric reactive compound comprises cyclic anhydride groups or salts thereof, such that the crosslinking reaction with a hydroxyl group on the cellulose is compensated in terms of hydrophilicity by the liberation of a carboxylic acid group or salt thereof (i.e., the anhydride ring is opened by the cross-linking reaction, resulting in an ester link to a former hydroxyl unit on the cellulose and the liberation of a carboxyl group that had previously been part of the anhydride). Since a carboxylic acid is known to generally be more hydrophilic than a hydroxyl group, the consumption of a hydroxyl group on the cellulose accompanied by the liberation of a nearby carboxyl group can be expected to increase or at least maintain the hydrophilicity of the system as crosslinking reactions proceed.

A catalyst may be added to the polymeric reactive compound to increase the rate of the reaction. The fibers are separated into individual form either before or after the fiber/chemical mixture is dried. The individualized fibers are then subjected to high temperatures for a sufficient time to initiate the cross-linking reaction. Once the high wet resiliency curly cellulose fibers are cross-linked, the wet curl index and water retention value can be evaluated. Suitably, the high wet resiliency curly fibers have a curl value greater than about 0.15, such as between about 0.15 and about 0.9, and a water retention value of at least 0.5 grams/gram.

Because of their remarkable absorbency, the high wet resiliency curly cellulose fibers are particularly suitable for use in absorbent articles, including diapers, training pants, feminine hygiene products, incontinence products, other personal care or health care garments, or the like.

These and other features, aspects, and advantages of the present invention will become better understood with regard to the following description and appended claims.

DETAILED DESCRIPTION OF THE PRESENTLY PREFERRED EMBODIMENTS

The present invention is generally directed to curly cellulose fibers having high wet resiliency. When these fibers get wet, they remain stiff enough to avoid collapsing despite the tendency of water to cause a collapse. By retaining their shape upon wetting, these fibers are able to maintain void volume in the form of a capillary structure during fluid acquisition and distribution, thus increasing absorbency.

Before describing representative embodiments of the invention, it is useful to define a number of terms for purposes of this application. These definitions are provided to assist the reader of this document.

"Cellulosic" or "cellulose" includes any material having cellulose as a major constituent, and specifically, comprising at least 50 percent by weight cellulose or a cellulose derivative. Thus, the term includes cotton, typical wood pulps, cellulose acetate, rayon, thermomechanical wood pulp, chemical wood pulp, debonded chemical wood pulp, milkweed floss, and the like.

"Wet resiliency" refers to the property of a material that enables the material to resume its original shape or position after being exposed to water or other liquid.

"Mechanically curly" refers to a fiber, for instance, that has been twisted or otherwise manipulated into curves, curls, or kinks.

"Intrafiber cross-linking" refers to the formation of crosslink bonds between two atoms on a single fiber.

"Fiber" or "fibrous" refers to a particulate material wherein the length to diameter ratio of such particulate material is greater than about 10. Conversely, a "nonfiber" or "nonfibrous" material is meant to refer to a particulate material wherein the length to diameter ratio of such particulate material is about 10 or less.

"Spunbonded fibers", or "spundbond fibers", means small-diameter fibers that are typically formed by extruding molten thermoplastic material as filaments from a plurality of fine capillaries of a spinneret having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al., each of which is incorporated by reference in its entirety and in a manner consistent with the present document. Spunbond fibers are quenched and generally not tacky when they are deposited onto a collecting surface. Spunbond fibers are generally continuous and often have average diameters larger than about 7 microns, and more particularly between about 10 and 30 microns. A spunbond material, layer, or substrate comprises spunbonded (or spunbond) fibers.

The term "meltblown fibers" means fibers formed by extruding a molten material, typically thermoplastic in nature, through a plurality of fine, usually circular, die capillaries as molten threads or filaments into converging high-velocity heated gas (e.g., air) streams that attenuate the filaments of molten material to reduce their diameter, which may be to microfiber diameter. Thereafter, the meltblown fibers are carried by the high-velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self-bonding when deposited onto a collecting surface.

"Polymer", as used herein, generally includes, but is not limited to, homopolymers, copolymers, such as, for example, block, graft, random and alternating copolymers, terpolymers, and blends and modifications thereof. As is explained in this document, polymers may assume different configurations, including isotactic, atactic, and syndiotactic configurations. "Configuration" describes those arrangements of atoms that cannot be altered except by breaking and reforming primary chemical bonds (i.e., covalent bonds). In contrast, "conformation" describes arrangements that can be altered by rotating groups of atoms around single bonds. It should be noted that a single polymer chain may be synthesized such that some portions of the chain have an isotactic configuration and some portions of the chain have an atactic configuration.

One version of a fiber possessing features of the present invention includes a mechanically curly fiber mixed with a polymeric reactive compound (PRC). A wide variety of fibers can be used in the invention, including but not limited to, cellulose fibers such as wood pulp fibers, non-woody paper-making fibers from cotton, from straws and grasses, such as rice and esparto, from canes and reeds, such as bagasse, from bamboos, from stalks with bast fibers, such as jute, flax, kenaf, cannabis, linen and ramie, and from leaf fibers, such as abaca and sisal. It is also possible to use mixtures of one or more cellulosic fibers and/or thermoplastic fibers.

The fiber can be chemically or mechanically curled. One chemical method (or more specifically, a chemically-assisted method) of curling the fiber involves Super-Molecular Structure Modification (SMSM) technology, which creates a super-molecular structurally modified fiber or mercerized fiber. A single fiber contains millions of micro-molecules. SMSM technology imparts mobility to the micro-molecular structure, thus leading to changes in the super-molecular structure. The super-molecular structure is essentially the packing mode of the fiber, which dictates the physical structure of the fiber. SMSM of cellulose fibers involves treating the fibers with an intra-crystalline swelling agent, then washing the swelling agent away. The intra-crystalline swelling agent causes orientation changes to an amorphous region of the fiber, along with crystal lattice re-structuring of a crystalline region of the fiber, or chain rearrangement. When the swelling agent is washed away, the fiber de-swells. Furthermore, when the swelling agent is washed away, all of the swelling agent chemical is removed and the remaining fiber is safe for use in articles contacting human skin.

The SMSM treated fiber maintains substantially the same chemistry as an untreated fiber, but the morphology of the SMSM treated fiber is different than the morphology of an untreated fiber. More particularly, the morphology of the SMSM treated fiber has an affinity to curl. The curled fiber possesses greater absorbent capacity than non-curled fibers.

A particularly suitable swelling agent is an aqueous solution of an alkali metal hydroxide, such as sodium hydroxide. The concentration of sodium hydroxide or other swelling agent is critical. Suitably, the concentration of the swelling agent is greater than 10%, or greater than 12%, or greater than 15%. For example, when the concentration of sodium hydroxide is about 10%, only the amorphous region of the fiber swells while the crystalline region of the fiber does not swell. However, when the concentration of sodium hydroxide is about 15% or greater, more specifically about 17% or greater, the swelling power of the sodium hydroxide can be so strong that the sodium hydroxide can penetrate into the crystalline region, thereby causing intra-crystalline swelling.

Without wishing to be bound by theory, the SMSM chemical curling method is believed to convert some cellulose in the cellulose I form to cellulose II, which is known to be more thermodynamically stable than cellulose I.

If desired, mechanical curling methods can also be used to further impart curl to fibers of the present invention. One known mechanical method of curling the fiber entails using a high-energy disperser. A suitable high-energy disperser is available from Clextral Company, Firminy Cedex, France, under the designation Bivis high-energy disperser. The Bivis high-energy disperser is a twin screw disperser. A mixture including cellulosic fibers is introduced through an inlet where the mixture encounters a short feed screw. The feed screw transfers the cellulosic fiber mixture to a first working zone. The working zone consists of a pair of intermeshing screws which are enclosed in a cylindrical housing. The screws co-rotate to transport the cellulosic fiber mixture axially through the disperser. High energy dispersing is achieved by using reverse-flighted screws which have small slots machined in the flights. Reverse-flighted screws are positioned periodically along the length of both screws and serve to reverse the flow of the cellulosic fiber mixture through the machine, thereby introducing back pressure. Pressure builds up in this zone and forces the cellulosic fiber mixture to flow through the slots in the reverse flights into the next forward flighted screw section which is at a lower pressure. This compression/expansion action imparts a high energy to the cellulosic fiber mixture during dispersion. Steam can be injected into the cellulosic fiber mixture to carry out high temperature dispersing. Typical conditions for using such a disperser include an energy level of about 6.0 horsepower-day per ton of cellulosic fiber mixture and a feed rate of cellulosic fiber mixture of about 2000 pounds per hour.

Another type of mechanically curled fibers is referred to as steam explosion fibers. The steam explosion process generally involves treating cellulosic fibers using an alkali metal hydroxide, and is explained in greater detail in U.S. Pat. No. 5,858,021, the entirety of which is hereby incorporated by reference.

Other suitable mechanically curly fibers include high temperature heat treated fibers, as described in U.S. Pat. No. 5,834,095 to Dutkiewicz, et al., the entirety of which is hereby incorporated by reference. In the high temperature heat treated process, the fibers are suitably heated to a temperature of at least 150 degrees Celsius, or at least 170 degrees Celsius.

The curl of a fiber may be quantified by a curl value which measures the fractional shortening of a fiber due to kink, twists, and/or bends in the fiber. For the purposes of this invention, a fiber's curl value is measured in terms of a two dimensional plane, determined by viewing the fiber in a two dimensional plane. To determine the curl value of a fiber, the projected length of a fiber as the longest dimension of a two dimensional rectangle encompassing the fiber, I, and the actual length of the fiber, L, are both measured. An image analysis method may be used to measure L and I. A suitable image analysis method is described in U.S. Pat. No. 4,898,642, incorporated herein in its entirety by reference. The curl value of a fiber can then be calculated from the following equation:

$$\text{Curl Value}=(L/I)-1$$

The curled fibers of the present invention suitably have a curl value greater than about 0.15, such as a curl value ranging from about 0.15 to about 0.75, or from about 0.2 to about 0.7, or from about 0.3 to about 0.65, or, alternatively, greater than any of 0.2., 0.3., and 0.4.

While curly fibers possess a considerable absorbent capacity, curly fibers alone cannot resist high pressure and tend to collapse under high pressure. A polymeric reactive compound (PRC) or polymeric anionic reactive compound (PARC) can be used as a cross-linking agent to set the curl which is then able to resist pressure and avoid collapse of the structure. In other words, the cross-linked curly fiber possesses considerable resiliency compared to non-crosslinked curly fibers. The polymeric reactive compound can effectively be added to the fibers at an addition amount of about 0.5% to about 10% based on fiber weight to provide intrafiber crosslinking, or at an addition amount of about 1% to about 8%, or about 1.5% to about 6%.

Useful polymeric anionic reactive compounds are compounds having repeating units containing two or more anionic functional groups that will covalently bond to hydroxyl groups of the cellulosic fibers. Such compounds will cause inter-fiber crosslinking between individual cellulose fibers. In one embodiment, the functional groups are carboxylic acids, anhydride groups, or the salts thereof. More specifically, the polymeric reactive compound can be a polycarboxylic acid, a polyanhydride, a copolymer comprising multiple carboxylic acid groups or cyclic anhydride groups or salts thereof, a polyaldehyde or copolymer comprising multiple aldehyde groups, and the like.

In a specific embodiment, the repeating units include two carboxylic acid groups on adjacent atoms, particularly adjacent carbon atoms, wherein the carboxylic acid groups are capable of forming cyclic anhydrides and specifically 5-member ring anhydrides. This cyclic anhydride, in the presence of a cellulosic hydroxyl group at elevated temperature, forms ester bonds with the hydroxyl groups of the cellulose.

Polymers, including copolymers, terpolymers, block copolymers, and homopolymers, of maleic acid are especially desired, including copolymers of acrylic acid and maleic acid, and salts thereof. Polyacrylic acid can be useful for the present invention if a significant portion of the polymer includes monomers that are joined head to head, rather than head to tail, to ensure that carboxylic acid groups are present on adjacent carbons.

Exemplary polymeric anionic reactive compounds include the ethylene/maleic anhydride copolymers described in U.S. Pat. No. 4,210,489 to Markofsky. Vinyl/maleic anhydride copolymers and copolymers of epichlorohydrin and maleic anhydride or phthalic anhydride are other examples. Copolymers of maleic anhydride with olefins can also be considered, including poly(styrene/maleic anhydride), as disclosed in German Patent No. 2,936,239. Copolymers and terpolymers of maleic anhydride that could be used are disclosed in U.S. Pat. No. 4,242,408 to Evani et al.

Desired polymeric reactive compounds are terpolymers of maleic acid, vinyl acetate, and ethyl acetate known as BELCLENE DP80 (Durable Press 80) and BELCLENE DP 60 (Durable Press 60), from FMC Corporation.

The polymeric anionic reactive compound desirably has a relatively low molecular weight and thus a low viscosity to permit effective spraying onto a tissue web. The polymeric anionic reactive compound desirably is a copolymer or terpolymer to improve flexibility of the molecule relative to the homopolymer alone. Improved flexibility of the molecule can be manifest by a reduced glass transition temperature as measured by differential scanning calorimetry. Useful polymeric anionic reactive compounds according to the present invention can have a molecular weight less than about 5,000, with an exemplary range of from about 500 to 5,000, more specifically less than about 3,000, more specifically still from about 600 to about 2,500, and most specifically from about 800 to 2,000. The polymeric anionic reactive compound BELCLENE DP80 used in the Example below is believed to have a molecular weight of from about 800 to about 1000. As used herein, molecular weight refers to number averaged molecular weight determined by gel permeation chromatography (GPC) or an equivalent method.

In aqueous solution, a low molecular weight compound such as BELCLENE DP80 will generally have a low viscosity, greatly simplifying the processing and application of the compound. In particular, low viscosity is especially desirable for spray application, whether the spray is to be applied uniformly or nonuniformly (e.g., through a template or mask) to the product. A saturated (50% by weight) solution of BELCLENE DP80, for example, has a room-temperature viscosity of about 9 centipoise, while the viscosity of a solution diluted to 2%, with 1% sodium hypophosphite catalyst, is approximately 1 centipoise (only marginally greater than that of pure water). In general, it is preferred that the polymeric anionic reactive compound to be applied to the paper web have a viscosity at 25 degrees Celsius of about 50 centipoise or less, specifically about 10 centipoise or less, more specifically about 5 centipoise or less, and most specifically from about 1 centipoise to about 2 centipoise. The solution at the application temperature desirably should exhibit a viscosity less than 10 centipoise and more specifically less than 4 centipoise. When the pure polymeric anionic reactive compound is at a concentration of either 50% by weight in water or as high as can be dissolved in water, whichever is greater, the liquid viscosity desirably is less than 100 centipoise, more specifically about 50 centipoise or less; more specifically still about 15 centipoise or less, and most specifically from about 4 to about 10 centipoise.

As used herein, viscosity is measured with a Sofrasser SA Viscometer (Villemandeur, France) connected to a type MIVI-6001 measurement panel. The viscometer employs a vibrating rod which responds to the viscosity of the surrounding fluid. To make the measurement, a 30 ml glass tube (Corex II No. 8445) supplied with the viscometer is filled with 10.7 ml of fluid and the tube is placed over the vibrating rod to immerse the rod in fluid. A steel guide around the rod receives the glass tube and allows the tube to be completely inserted into the device to allow the liquid depth over the vibrating rod to be reproducible. The tube is held in place for 30 seconds to allow the centipoise reading on the measurement panel to reach a stable value.

Another useful aspect of the polymeric anionic reactive compounds used in the present invention is that relatively high pH values can be used when the catalyst is present, making the compound more suitable for neutral and alkaline papermaking processes and more suitable for a variety of processes, machines, and fiber types. The mixture of the curled fibers and the polymeric reactive compound is acidic, with a pH range between about 1.5 and about 5.5, or between about 2 and about 5, or between about 2.5 and about 4.5. However, polymeric anionic reactive compound solutions with added catalyst can have a pH above 3, more specifically above 3.5, more specifically still above 3.9, and most specifically of about 4 or greater, with an exemplary range of from 3.5 to 7 or from 4.0 to 6.5.

The polymeric anionic reactive compounds (PARC) of the present invention can yield wet:dry tensile ratios much higher than traditional wet strength agents, with values reaching ranges as high as from 40% to 85%, for example.

The PARC need not be neutralized prior to treatment of the fibers. In particular, the PARC need not be neutralized with a fixed base. As used herein, a fixed base is a monovalent base that is substantially nonvolatile under the conditions of treatment, such as sodium hydroxide, potassium hydroxide, or sodium carbonate, and t-butylammonium hydroxide. However, it can be desirable to use co-catalysts, including volatile basic compounds such as imidazole or triethyl amine, with sodium hypophosphite or other catalysts.

Suitable catalysts include any catalyst that increases the rate of bond formation between the PARC and cellulose fibers. Desired catalysts include alkali metal salts of phosphorous containing acids such as alkali metal hypophosphites, alkali metal phosphites, alkali metal polyphosphonates, alkali metal phosphates, and alkali metal sulfonates. Particularly desired catalysts include alkali metal polyphosphonates such as sodium hexametaphosphate, and alkali metal hypophosphites such as sodium hypophosphite. Several organic compounds are known to function effectively as catalysts as well, including imidazole (IMDZ) and triethyl amine (TEA). Inorganic compounds such as aluminum chloride and organic compounds such as hydroxyethane diphosphoric acid can also promote crosslinking.

Other specific examples of effective catalysts are disodium acid pyrophosphate, tetrasodium pyrophosphate, pentasodium tripolyphosphate, sodium trimetaphosphate, sodium tetrametaphosphate, lithium dihydrogen phosphate, sodium dihydrogen phosphate and potassium dihydrogen phosphate.

When a catalyst is used to promote bond formation, the catalyst is typically present in an amount in the range from about 5 to about 100 weight percent of the PARC. Desirably, the catalyst is present in an amount of about 25 to 75% by weight of the polycarboxylic acid, most desirably about 50% by weight of the PARC.

In addition to various versions of curly cellulose fibers having high wet resiliency, and absorbent products containing such fibers, the present invention also encompasses methods of making these fibers.

In carrying out the method of making high wet resiliency curly cellulose fibers, the mechanically curly cellulose fibers are mixed with the polymeric reactive compound. As mentioned, a catalyst may also be mixed with the fibers and the polymeric reactive compound. After the fibers and the polymeric reactive compound are mixed, the mixture is dried, suitably to a dryness level of at least 80%. The fibers are separated into individual form either before or after the mixture is dried. The individualized fibers are then subjected to high temperatures, between about 150 Celsius and about 190 Celsius, for a sufficient length of time to initiate the intrafiber cross-linking reaction.

Depending on the nature of the curl of a cellulosic fiber, such curl may be stable when the cellulosic fiber is dry but may be unstable when the cellulosic fiber is wet. The cellulosic fibers of the present invention have been found to exhibit a substantially stable fiber curl when wet. This property of the cellulosic fibers may be quantified by a wet curl value, as measured according to the test method described herein, which is a length weighted mean curl average of a designated number of fibers, such as about 4000, from a fiber sample. As such, the wet curl value is the summation of the individual wet curl values for each fiber multiplied by the fiber's actual length, L, divided by the summation of the actual lengths of the fibers. It is hereby noted that the wet curl value, as determined herein, is calculated by only using the necessary values for those fibers with a length of greater than about 0.4 millimeter. The fibers of the present invention suitably have a wet curl value of about 0.1 or greater, or about 0.2 or greater, or between about 0.1 and about 0.5, or between about 0.2 and about 0.4, or between about 0.3 and about 0.4.

Water retention value (WRV) is a measure that can be used to characterize some fibers useful for purposes of this invention. WRV is measured by dispersing 0.5 gram of fibers in deionized water, soaking overnight, then centrifuging the fibers in a 1.9-inch diameter tube with a 100 mesh screen at the bottom at 1000 G for 20 minutes. The samples are weighed, then dried at 105 Celsius for two hours and then weighed again. WRV is calculated as (wet weight−dry weight)/dry weight. The fibers of the present invention suitably have a WRV of at least 0.4 grams/gram, or at least 0.5 grams/gram, or at least 0.6 grams/gram, or at least 0.7 grams/gram.

Because of their remarkable absorbency, the high wet resiliency curly cellulose fibers are particularly suitable for use in absorbent materials and absorbent articles, including diapers, training pants, swim wear, feminine hygiene products, incontinence products, other personal care or health care garments, including medical garments, or the like. It should be understood that the present invention is applicable to other structures, composites, or products incorporating adhesive high wet resiliency curly cellulose fibers of the present invention.

EXAMPLE

SMSM-CR54 fibers were made according to the method described in U.S. Pat. No. 5,858,021. The curl index of the SMSM-CR54 fibers was 0.336 and the WRV of the SMSM-CR54 fibers was between 1.02 and 1.05 g/g. One hundred grams (100 g) of the dry SMSM-CR54 fibers were wetted with 100 g of deionized water and mixed with an additional 100 g of deionized water. BELCLENE DP80 polymeric reactive compound and sodium hypophosphite catalyst were added to the fibers at an addition amount of 3 wt % and 1.5 wt %, respectively, based on dry weight of the fibers, to provide intrafiber cross-linking. The wetted SMSM-CR54 fibers, polymeric reactive compound, and catalyst were thoroughly mixed in a mixer at room temperature (25 degrees Celsius) for about 30 to 40 minutes. After the mixing, the fibers were then thoroughly dried at room temperature to avoid any chemical reactions between the fibers. After the fibers were thoroughly dried, the fibers were then individualized at room temperature using a fiberizer. The fibers were individualized, i.e. set apart from one another, to prevent the polymeric reactive compound and the catalyst from reacting between fibers as interfiber reactions, and instead limiting the reactions of the polymeric reactive compound and the catalyst to occurring within only single fibers as intrafiber reactions. The individualized fibers were then cured at 170 degrees Celsius for 2 minutes to initiate intrafiber cross-linking.

After the fibers were cured, the fibers were then re-tested for curl index and WRV. The curl index of the resulting fibers remained substantially unchanged at 0.34, while the WRV of the resulting fibers was reduced significantly to 0.713 g/g.

Tests/Procedures

Wet Curl of Fibers

The Wet Curl value for fibers was determined by using an instrument which rapidly, accurately, and automatically determines the quality of fibers, the instrument being available from OpTest Equipment Inc., Hawkesbury, Ontario, Canada, under the designation Fiber Quality Analyzer, OpTest Product Code DA93.

A sample of never-dried, alkali-metal-hydroxide-treated cellulosic fibers was obtained. The cellulosic fiber sample was poured into a 600 milliliter plastic sample beaker to be used in the Fiber Quality Analyzer. The fiber sample in the beaker was diluted with tap water until the fiber concentration in the beaker was about 10 to about 25 fibers per second for evaluation by the Fiber Quality Analyzer.

An empty plastic sample beaker was filled with tap water and placed in the Fiber Quality Analyzer test chamber. The Fiber Quality Analyzer then performed a self-test. If a warning was not displayed on the screen after the self-test, the machine was ready to test the fiber sample.

The plastic sample beaker filled with tap water was removed from the test chamber and replaced with the fiber sample beaker. The measuring process of the Fiber Quality Analyzer was then begun. An identification of the fiber sample was then typed into the Fiber Quality Analyzer. The fiber count was set at 4,000. The parameters of scaling of a graph to be printed out may be set automatically or to desired values. The Fiber Quality Analyzer then began testing and displayed the fibers passing through the flow cell. The Fiber Quality Analyzer also displayed the fiber frequency passing through the flow cell, which should be about 10 to about 25 fibers per second. If the fiber frequency is outside of this range, the fiber sample should be diluted or have more fibers added to bring the fiber frequency within the desired range. If the fiber frequency is sufficient, the Fiber Quality Analyzer tests the fiber sample until it has reached a count of 4000 fibers at which time the Fiber Quality Analyzer automatically stops. The Fiber Quality Analyzer calculates the Wet Curl value of the fiber sample.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A high wet resiliency curly cellulose fiber comprising:

a cellulose fiber treated with an intra-crystalline swelling agent and having a curl value of at least 0.15; and a polymeric reactive compound applied to the treated cellulose fiber to create a high wet resiliency curly cellulose fiber;

the high wet resiliency curly cellulose fiber having a wet curl value of at least 0.1.

2. The high wet resiliency curly cellulose fiber of claim 1, wherein the polymeric reactive compound comprises a polymeric compound having repeating units containing two or more anionic functional groups that will covalently bond to hydroxyl groups of the cellulosic fibers.

3. The high wet resiliency curly cellulose fiber of claim 2, wherein the functional groups are carboxylic acids.

4. The high wet resiliency curly cellulose fiber of claim 3, wherein the carboxylic acids are on adjacent carbons and are capable of forming a cyclic anhydride.

5. The high wet resiliency curly cellulose fiber of claim 1, wherein the polymeric reactive compound is a copolymer of maleic acid.

6. The high wet resiliency curly cellulose fiber of claim 1, wherein the polymeric reactive compound is a salt of a copolymer of maleic acid.

7. The high wet resiliency curly cellulose fiber of claim 1, wherein the cellulose fiber is structurally modified using super-molecular structure modification technology comprising treatment with an aqueous solution of an alkali metal hydroxide having a concentration greater than about 10% by weight.

8. The high wet resiliency curly cellulose fiber of claim 1, wherein the cellulose fiber is structurally modified using a high-energy disperser.

9. The high wet resiliency curly cellulose fiber of claim 1, wherein the cellulose fiber comprises a steam explosion fiber.

10. The high wet resiliency curly cellulose fiber of claim 1, wherein the cellulose fiber comprises a high temperature heat treated fiber having been heated to a temperature of at least 170 degrees Celsius.

11. The high wet resiliency curly cellulose fiber of claim 1, wherein the cellulose fiber has a curl value in a range between about 0.15 and about 0.75.

12. The high wet resiliency curly cellulose fiber of claim 1, wherein the cellulose fiber has a curl value in a range between about 0.2 and about 0.7.

13. The high wet resiliency curly cellulose fiber of claim 1, wherein the cellulose fiber has a curl value in a range between about 0.3 and about 0.65.

14. The high wet resiliency curly cellulose fiber of claim 1, wherein the cellulose fiber has a curl value of at least 0.2.

15. The high wet resiliency curly cellulose fiber of claim 1, wherein the cellulose fiber has a curl value of at least 0.3.

16. The high wet resiliency curly cellulose fiber of claim 1, wherein the cellulose fiber has a curl value of at least 0.4.

17. The high wet resiliency curly cellulose fiber of claim 1, wherein the high wet resiliency curly cellulose fiber has a wet curl value of at least 0.2.

18. The high wet resiliency curly cellulose fiber of claim 1, wherein the high wet resiliency curly cellulose fiber has a wet curl value in a range between about 0.2 and about 0.4.

19. The high wet resiliency curly cellulose fiber of claim 1, wherein the high wet resiliency curly cellulose fiber has a wet curl value in a range between about 0.3 and about 0.4.

20. The high wet resiliency curly cellulose fiber of claim 1 having a water retention value of at least 0.4 grams/gram.

21. The high wet resiliency curly cellulose fiber of claim 1 having a water retention value of at least 0.5 grams/gram.

22. The high wet resiliency curly cellulose fiber of claim 1 having a water retention value of at least 0.6 grams/gram.

23. The high wet resiliency curly cellulose fiber of claim 1 having a water retention value of at least 0.7 grams/gram.

24. A high wet resiliency curly cellulose fiber comprising:

a structurally modified cellulose fiber treated with an intra-crystalline swelling agent using super-molecular structure modification technology comprising treatment with an aqueous solution of a metal hydroxide having a concentration greater than about 10% by weight; and a polymeric reactive compound and a catalyst applied to the treated cellulose fiber to create a high wet resiliency curly cellulose fiber, the high wet resiliency curly cellulose fiber having a water retention value of at least 0.4 grams/gram and a curl value of at least about 0.15.

25. The high wet resiliency curly cellulose fiber of claim 24, wherein the polymeric reactive compound comprises a polymeric compound having repeating units containing two or more anionic functional groups that will covalently bond to hydroxyl groups of the cellulosic fibers.

26. The high wet resiliency curly cellulose fiber of claim 25, wherein the functional groups are carboxylic acids.

27. The high wet resiliency curly cellulose fiber of claim 26, wherein the carboxylic acids are on adjacent carbons and are capable of forming a cyclic anhydride.

28. The high wet resiliency curly cellulose fiber of claim 24, wherein the polymeric reactive compound is a copolymer of maleic acid.

29. The high wet resiliency curly cellulose fiber of claim 24, wherein the polymeric reactive compound is salt of a copolymer of maleic acid.

30. The high wet resiliency curly cellulose fiber of claim 24, wherein the cellulose fiber is structurally modified using a high-energy disperser.

31. The high wet resiliency curly cellulose fiber of claim 24, wherein the cellulose fiber comprises a steam explosion fiber.

32. The high wet resiliency curly cellulose fiber of claim 24, wherein the cellulose fiber comprises a high temperature heat treated fiber having been heated to a temperature of at least 150 degrees Celsius.

33. The high wet resiliency curly cellulose fiber of claim 24, wherein the catalyst comprises an alkali metal salt of a phosphorous-containing acid.

34. The high wet resiliency curly cellulose fiber of claim 33, wherein the alkali metal salt of a phosphorous-containing acid is selected from the group consisting of alkali metal hypophosphites, alkali metal phosphites, alkali metal polyphosphonates, alkali metal phosphates, and alkali metal sulfonates.

35. The high wet resiliency curly cellulose fiber of claim 24, wherein the catalyst is selected from the group consisting of an imidazole, a triethyl amine, aluminum chloride, hydroxyethane diphosphoric acid, disodium acid pyrophosphate, tetrasodium pyrophosphate, pentasodium tripolyphosphate, sodium trimetaphosphate, sodium tetrametaphosphate, lithium dihydrogen phosphate, sodium dihydrogen phosphate, and potassium dihydrogen phosphate.

36. The high wet resiliency curly cellulose fiber of claim 24, wherein the cellulose fiber has a curl value in a range between about 0.15 and about 0.75.

37. The high wet resiliency curly cellulose fiber of claim 24, wherein the cellulose fiber has a curl value in a range between about 0.2 and about 0.7.

38. The high wet resiliency curly cellulose fiber of claim 24, wherein the cellulose fiber has a curl value in a range between about 0.3 and about 0.65.

39. The high wet resiliency curly cellulose fiber of claim 24, wherein the curly cellulose fiber has a wet curl value of at least 0.1.

40. The high wet resiliency curly cellulose fiber of claim 24, wherein the curly cellulose fiber has a wet curl value of at least 0.2.

41. The high wet resiliency curly cellulose fiber of claim 24, wherein the curly cellulose fiber has a wet curl value in a range between about 0.2 and about 0.4.

42. The high wet resiliency curly cellulose fiber of claim 24, wherein the curly cellulose fiber has a wet curl value in a range between about 0.3 and about 0.4.

43. The high wet resiliency curly cellulose fiber of claim 24 having a water retention value of at least 0.5 grams/gram.

44. The high wet resiliency curly cellulose fiber of claim 24 having a water retention value of at least 0.6 grains/gram.

45. The high wet resiliency curly cellulose fiber of claim 24 having a water retention value of at least 0.7 grams/gram.

46. A method of making high wet resiliency curly cellulose fibers, comprising the steps of:

structurally modifying a plurality of fibers using super-molecular structure modification technology, in which the plurality of fibers is treated with an intra-crystalline swelling agent and the swelling agent is subsequently washed away from the plurality of fibers, to create a plurality of curly cellulose fibers;

mixing a plurality of the curly cellulose fibers with a polymeric reactive compound;

drying the mixture of curly cellulose fibers and polymeric reactive compound;

separating the curly cellulose fibers into individual form; and subjecting the individualized curly cellulose fibers to a temperature in a range between about 150 degrees Celsius and about 190 degrees Celsius for a sufficient length of time to initiate an intrafiber cross-linking reaction.

47. The method of claim 46, wherein the curly cellulose fibers are separated into individual form before the mixture of curly cellulose fibers and polymeric reactive compound is dried to a dryness level of at least 80%.

48. The method of claim 46, wherein the curly cellulose fibers are separated into individual form after the mixture of curly cellulose fibers and polymeric reactive compound is dried.

49. The method of claim 46, wherein the polymeric reactive compound comprises a polymeric compound having repeating units containing two or more anionic functional groups that will covalently bond to hydroxyl groups of the cellulosic fibers.

50. The method of claim 49, wherein the functional groups are carboxylic acids.

51. The method of claim 50, wherein the carboxylic acids are on adjacent carbons and are capable of forming a cyclic anhydride.

52. The method of claim 46, wherein the polymeric reactive compound is a copolymer of maleic acid.

53. The method of claim 46, further comprising the step of mixing the plurality of curly cellulose fibers and the polymeric reactive compound with a catalyst.

54. The method of claim 53, wherein the catalyst comprises an alkali metal salt of a phosphorous-containing acid.

55. The method of claim 53, wherein the alkali metal salt of a phosphorous-containing acid is selected from the group consisting of alkali metal hypophosphites, alkali metal phosphites, alkali metal polyphosphonates, alkali metal phosphates, and alkali metal sulfonates.

56. The method of claim 53, wherein the catalyst is selected from the group consisting of an imidazole, a triethyl amine, aluminum chloride, hydroxyethane diphosphoric acid, disodium acid pyrophosphate, tetrasodium pyrophosphate, pentasodium tripolyphosphate, sodium trimetaphosphate, sodium tetrametaphosphate, lithium dihydrogen phosphate, sodium dihydrogen phosphate, and potassium dihydrogen phosphate.

57. The method of claim 46, wherein the concentration of the swelling agent is greater than 10%.

58. The method of claim 46, wherein the concentration of the swelling agent is greater than 15%.

59. The method of claim 46, wherein the swelling agent comprises sodium hydroxide.

60. The method of claim 46, further comprising the step of structurally modifying a plurality of fibers using a high-energy disperser to create the plurality of curly cellulose fibers.

61. The method of claim 46, wherein the plurality of curly cellulose fibers comprises a plurality of steam explosion fibers.

62. The method of claim 46, wherein the plurality of curly cellulose fibers comprises a plurality of high temperature heat treated fibers.

63. The method of claim 46, wherein the plurality of curly cellulose fibers has a curl value in a range between about 0.15 and about 0.75.

64. The method of claim 46, wherein the plurality of curly cellulose fibers has a curl value in a range between about 0.15 and about 0.7.

65. The method of claim 46, wherein the plurality of curly cellulose fibers has a curl value in a range between about 0.2 and about 0.65.

66. The method of claim 46, wherein the plurality of curly cellulose fibers has a wet curl value in a range between about 0.1 and about 0.5.

67. The method of claim 46, wherein the plurality of curly cellulose fibers has a wet curl value in a range between about 0.2 and about 0.4.

68. The method of claim 46, wherein the plurality of curly cellulose fibers has a wet curl value in a range between about 0.3 and about 0.4.

69. The method of claim 46, wherein the polymeric reactive compound is mixed with the plurality of curly cellulose fibers at an addition amount in a range between about 0.5% and about 10% by weight of the curly cellulose fibers.

70. The method of claim 46, wherein the polymeric reactive compound is mixed with the plurality of curly cellulose fibers at an addition amount in a range between about 1% and about 8% by weight of the curly cellulose fibers.

71. The method of claim 46, wherein the polymeric reactive compound is mixed with the plurality of curly cellulose fibers at an addition amount in a range between about 1.5% and about 6% by weight of the curly cellulose fibers.

72. The method of claim 46, wherein the high wet resiliency curly cellulose fibers have a water retention value of at least 0.5 grams/gram.

73. The method of claim 46, wherein the high wet resiliency curly cellulose fibers have a water retention value of at least 0.6 grams/gram.

74. The method of claim 46, wherein the high wet resiliency curly cellulose fibers have a water retention value of at least 0.7 grams/gram.

* * * * *